US006537092B2

(12) United States Patent
Hirai et al.

(10) Patent No.: US 6,537,092 B2
(45) Date of Patent: Mar. 25, 2003

(54) ARC DISCHARGE SUPPRESSIVE CONNECTOR

(75) Inventors: Hiroki Hirai, Nagoya (JP); Kouji Ota, Nagoya (JP); Yoshitsugu Tsuji, Nagoya (JP); Hiroto Ueno, Nagoya (JP); Shigeki Sakai, Nagoya (JP); Kenji Inoue, Yokkaichi (JP); Takeshi Tsuji, Yokkaichi (JP); Yoshiyuki Miyazaki, Nagoya (JP)

(73) Assignees: Autonetworks Technologies, Ltd, Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/059,391

(22) Filed: Jan. 31, 2002

(65) Prior Publication Data

US 2002/0106921 A1 Aug. 8, 2002

(30) Foreign Application Priority Data

Feb. 2, 2001 (JP) ..... 2001-026589
Dec. 17, 2001 (JP) ..... 2001-383402

(51) Int. Cl.[7] ..... H01R 13/53
(52) U.S. Cl. ..... 439/181; 439/88
(58) Field of Search ..... 139/181–187, 139/88, 87, 86, 89, 90, 934

(56) References Cited

U.S. PATENT DOCUMENTS

| | | | | |
|---|---|---|---|---|
| 3,691,511 A | | 9/1972 | Billmann | 439/181 |
| 3,867,602 A | * | 2/1975 | Jawelak | 200/163 |
| 5,591,039 A | * | 1/1997 | Matthews | 439/181 |
| 6,296,499 B1 | * | 10/2001 | Hermann, Jr. et al. | 439/181 |
| 6,382,998 B2 | * | 5/2002 | Miwa | 439/181 |

FOREIGN PATENT DOCUMENTS

| | | |
|---|---|---|
| EP | 0 553 618 A1 | 8/1993 |
| JP | A 2001-250610 | 9/2001 |
| JP | A 2001-250621 | 9/2001 |
| JP | A 2001-250622 | 9/2001 |
| JP | A 2001-250646 | 9/2001 |
| JP | A 2001-250647 | 9/2001 |
| JP | A 2001-266985 | 9/2001 |
| JP | A 2001-266986 | 9/2001 |
| JP | A 2001-266987 | 9/2001 |
| JP | A 2001-267014 | 9/2001 |
| JP | A 2001-307821 | 11/2001 |
| JP | A 2001-307834 | 11/2001 |
| JP | A 2001-307839 | 11/2001 |
| JP | A 2001-351726 | 12/2001 |

* cited by examiner

*Primary Examiner*—P. Austin Bradley
*Assistant Examiner*—Ross Gushi
(74) *Attorney, Agent, or Firm*—Oliff & Berridge PLC

(57) ABSTRACT

Disclosed is a connector having a terminal which is rendered into an electrically connectable state with a counterpart terminal by engaging with the counterpart terminal; a housing for accommodating the terminal therein; and an arc suppressive member which is provided at such a position as to be electrically connectable to the terminal and rendered into contact with the counterpart terminal when the terminal is being disengaged from the counterpart terminal so as to keep on electrically connecting the terminal and the counterpart terminal. The arc suppressive member has such a construction that an amount of discharged arc when the arc suppressive member is detached from the counterpart terminal is smaller than an amount of discharged arc when the terminal is disengaged from the counterpart terminal. With this arrangement, arc discharge at the disengagement of the terminals is suppressed.

14 Claims, 7 Drawing Sheets

ARC DISCHARGE SUPPRESSIVE CONNECTOR

BACKGROUND OF THE INVENTION

1. Field of the Invention

This invention relates to a connector for use in a wire harness in an automotive vehicle, and a terminal for use in such a connector.

2. Description of the Related Art

It is a general practice to detach connectors used in an automotive vehicle or the like therefrom every several months or every several years for maintenance and checkup thereof. It is highly likely that arc discharge may occur at a detachment of terminals of the connectors when the terminal of one of the connectors is about to be withdrawn from the corresponding terminal of the opposite one of the connectors. Particularly, it is conceivable that a considerably large amount of arc is discharged in view of the recent development of technology in which a higher source voltage is supplied for a battery of an automotive vehicle. Thus, it is highly likely that the terminals may be damaged due to occurrence of such large amount of arc discharge.

Generally, a male terminal has a bar-like or a plate-like shape with a lead end thereof tapered in order to facilitate insertion into a female terminal. Every time the male terminal is disengaged from and engaged into the female terminal, arc discharge occurs. The repeated engagement and disengagement causes to melt the tapered lead end of the male terminal due to repeated arc discharges. The melted part of the male terminal is cooled to solidify, accompanied with shifting of the melted part slightly toward a base end thereof. As a result, the tapered lead end of the male terminal disappears accompanied by increase of a diameter thereof. In other words, the terminal is likely to be deformed due to melting by repeated arc discharges, which may result in contact failure with the female terminal or, in a worse case, difficulty or inability of insertion into the female terminal.

SUMMARY OF THE INVENTION

It is an object of the invention to provide a connector which is free from the problems residing in the prior art.

According to an aspect of the invention, a connector comprises a terminal electrically connectable with a counterpart terminal, a housing for accommodating the terminal therein, and an arc suppressive member which is electrically connected with the terminal and is provided at such a position as to come into contact with the counterpart terminal for a predetermined time after the counterpart terminal is disengaged from the terminal, the arc suppressive member having such a construction as to assure a smaller discharge arc amount when the counterpart terminal becomes detached from the arc suppressive member than a discharge arc amount when the counterpart terminal becomes detached from the terminal.

These and other objects, features and advantages of the present invention will become more apparent upon a reading of the following detailed description and accompanying drawing.

DETAILED DESCRIPTION OF THE PREFERRED EMBODIMENTS OF THE INVENTION

An arc suppressive connector in accordance with a first embodiment of the invention is described in detail with reference to FIGS. 1 through 5E.

Figure 1:
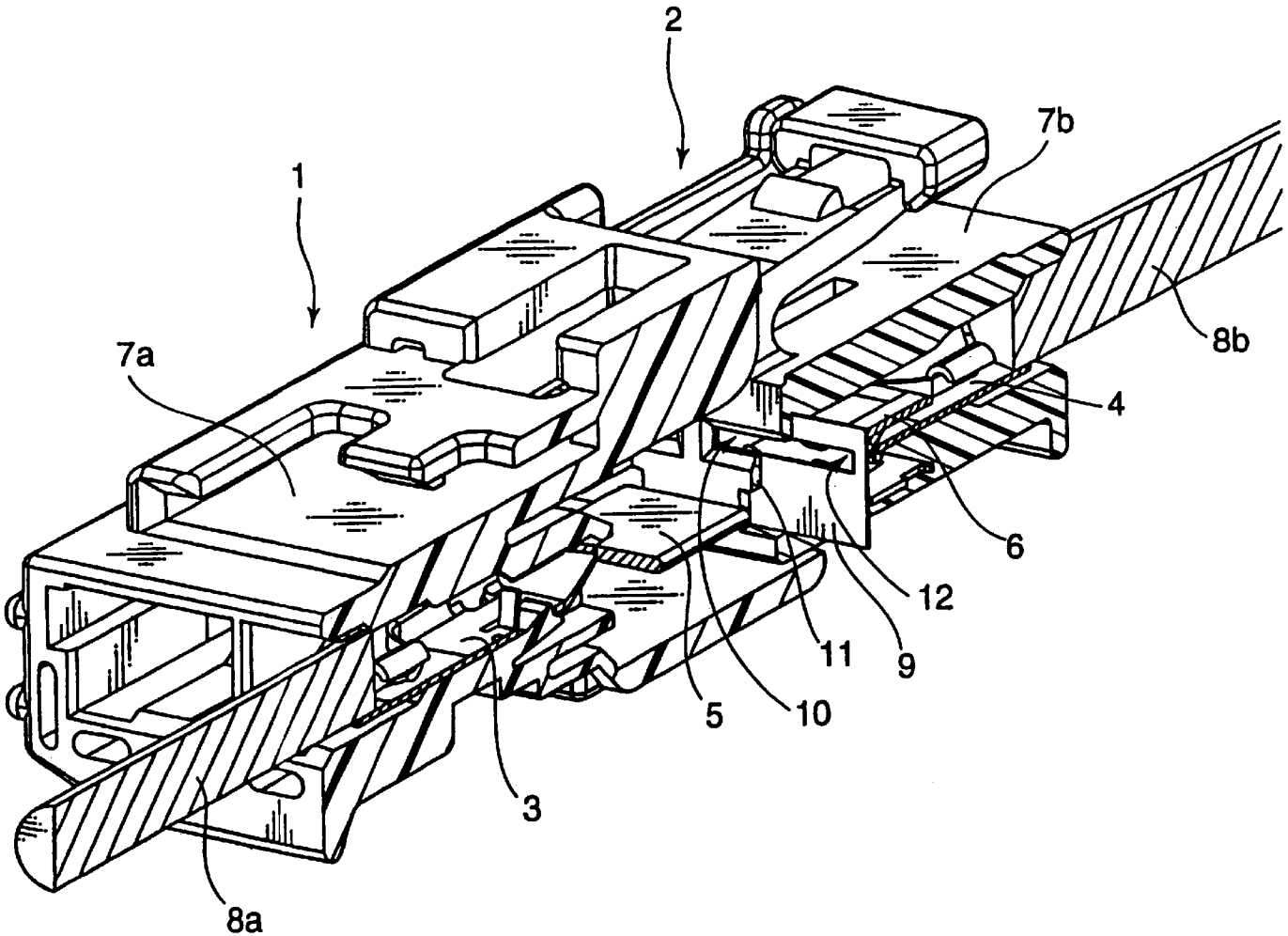
FIG. 1 is a partly broken perspective view showing a state that a connector capable of suppressing arc discharge in accordance with a first embodiment of the invention is engaged with a counterpart connector.
Figure 2:
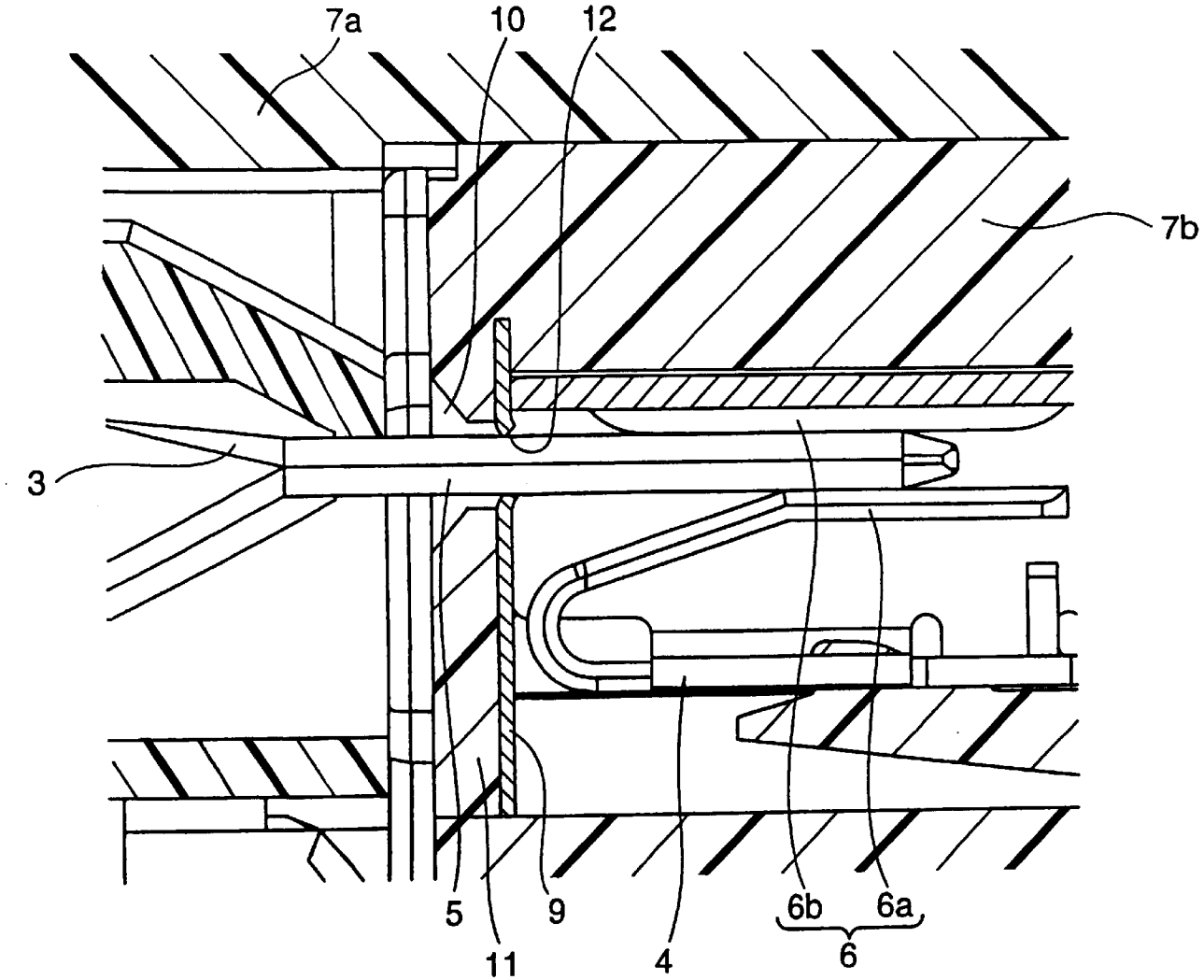
FIG. 2 is a sectional side view showing a state that terminals in the connectors shown in FIG. 1 are engaged.

FIGS. 1 and 2 are diagrams showing a female connector 2 which is an arc suppressive connector in accordance with the first embodiment, and a male connector 1 which is to be engaged with the female connector 2.

The male connector 1 is provided with a plurality of male terminals 3, and a housing 7*a* for accommodating the male terminals 3. Each of the male terminals 3 has a substantially plate-like male electric contact part (male tab) 5 at a front portion thereof, and has a rear portion thereof electrically connected to a terminal of a wire 8*a*. The male tab 5 protrudes forwardly from the front surface of the housing 7*a*.

The female connector 2 is provided with a plurality of female terminals 4 and a housing 7*b* for accommodating the female terminal 4 therein. Each of the female terminal 4 has a female electric contact part 6 engageable with the male electric contact part 5 at a front portion thereof, and has a rear portion thereof electrically connected to a terminal of a wire 8*b*. The housing 7*b* is formed with an opening 100 opened forwardly through which the male tab 5 is rendered into contact with the female electric contact part 6 of the housing 7*b*.

The female electric contact part 6 has a resilient tongue-like piece (spring piece) 6*a* which is constructed by folding a plate with one end thereof extending rearwardly as shown in FIG. 2, and a plate-like piece 6*b* which opposes the spring piece 6*a*. The spring piece 6*a* is biased toward the plate-like piece 6*b* to securely hold the male tab 5 inserted in the housing 7*b* therebetween. Hereinafter, the female electric contact part 6 is simply referred to as "nipping portion 6". Engaging the male connector 1 and the female connector 2 enables to electrically connect the male terminals 3 and the corresponding female terminals 4 to thereby render the connectors 1 and 2 electrically connectable.

When the male terminal 3 is about to be disengaged from the corresponding female terminal 4 from the engaged state, arc discharge may occur at a contact portion between the male tab 5 and the nipping portion 6, which may damage the male tab 5 and the nipping portion 6. In view of this, in this embodiment, a conductive member 9 made of metallic film is interposed between the male terminal 3 and the female terminal 4 to maintain the conductive state of the connectors 1 and 2 by the contact of the male tab 5 and the conductive metallic film 9 even when the male tab 5 is about to be detached from the nipping portion 6. In this way, arc discharge at the contact portion between the male tab 5 and the nipping portion 6 is prevented.

Specifically, the female connector 2 is constructed in such a manner that the conductive metallic film 9 is adhered on the backside of a front wall (front end wall) 11 of the housing 7*b*, and a front end of the male tab 4 is pressed against the backside of the metallic film 9. With this arrangement, peeling off of the metallic film 9 is prevented while electrically connecting the metallic film 9 and the female terminal 4.

The conductive metallic film 9 is formed with an opening 12 having a sectional area slightly smaller than the cross section of the male tab 5 at a position corresponding to an opening 10 of the front wall 11. The male tab 5 and an inner periphery of the opening 12 of the metallic film 9 are rendered into an electrical contact state when the male tab 5 is inserted in the opening 12.

Figure 3:
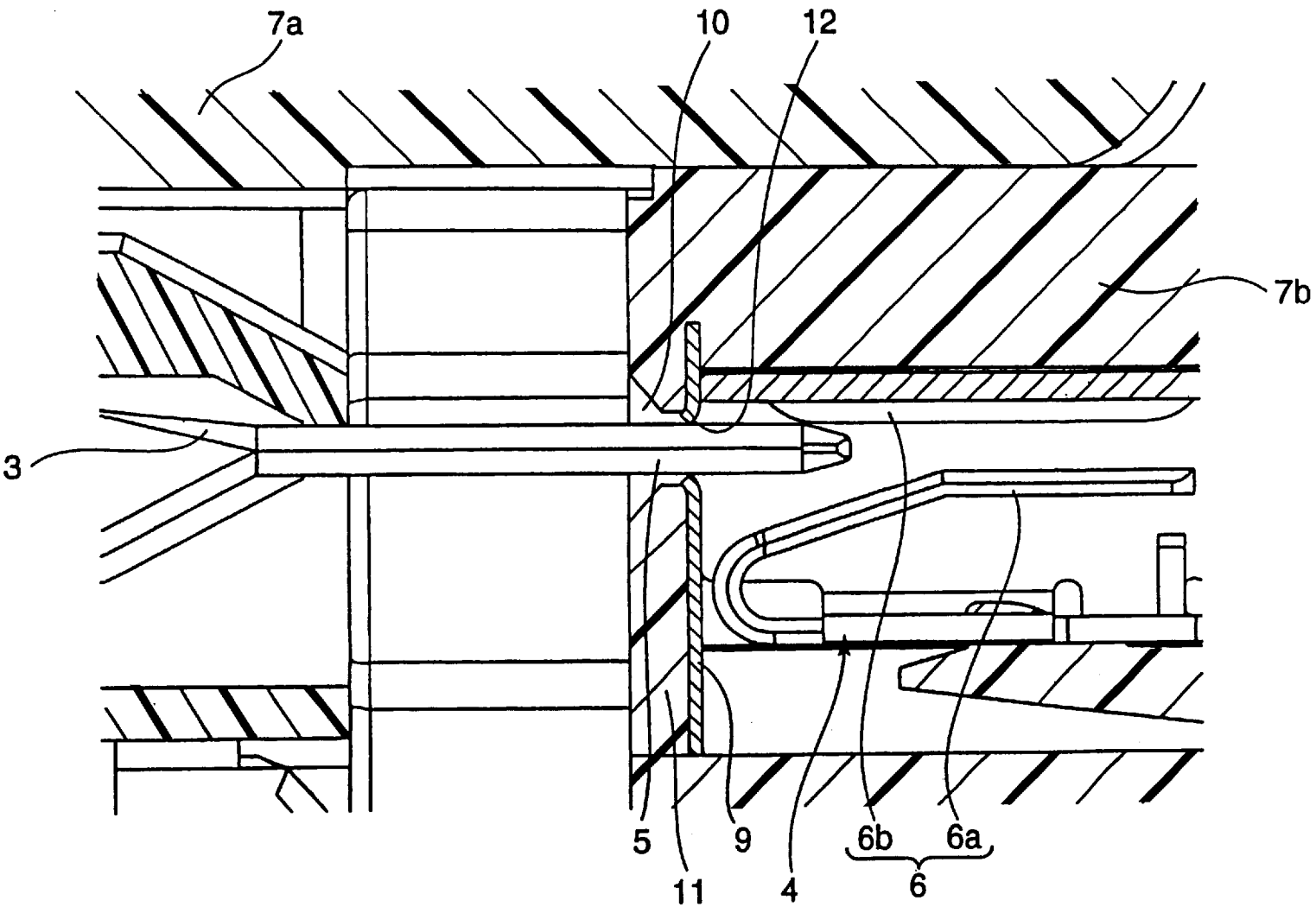
FIG. 3 is a sectional side view showing a state that the terminals shown in FIG. 2 are about to be disengaged from each other.

In the female connector 2 thus constructed, current is kept on being supplied between the terminals 3 and 4 via the metallic film 9 due to the contact between the male tab 5 and the conductive metallic film 9 which is formed at a forward portion with respect to the nipping portion 6, as shown in FIG. 3 even when the male tab 5 is detached from the nipping portion 6. This arrangement eliminates occurrence of arc discharge at the contact portion between the male tab 5 and the nipping portion 6 at a detachment thereof.

Figure 4:
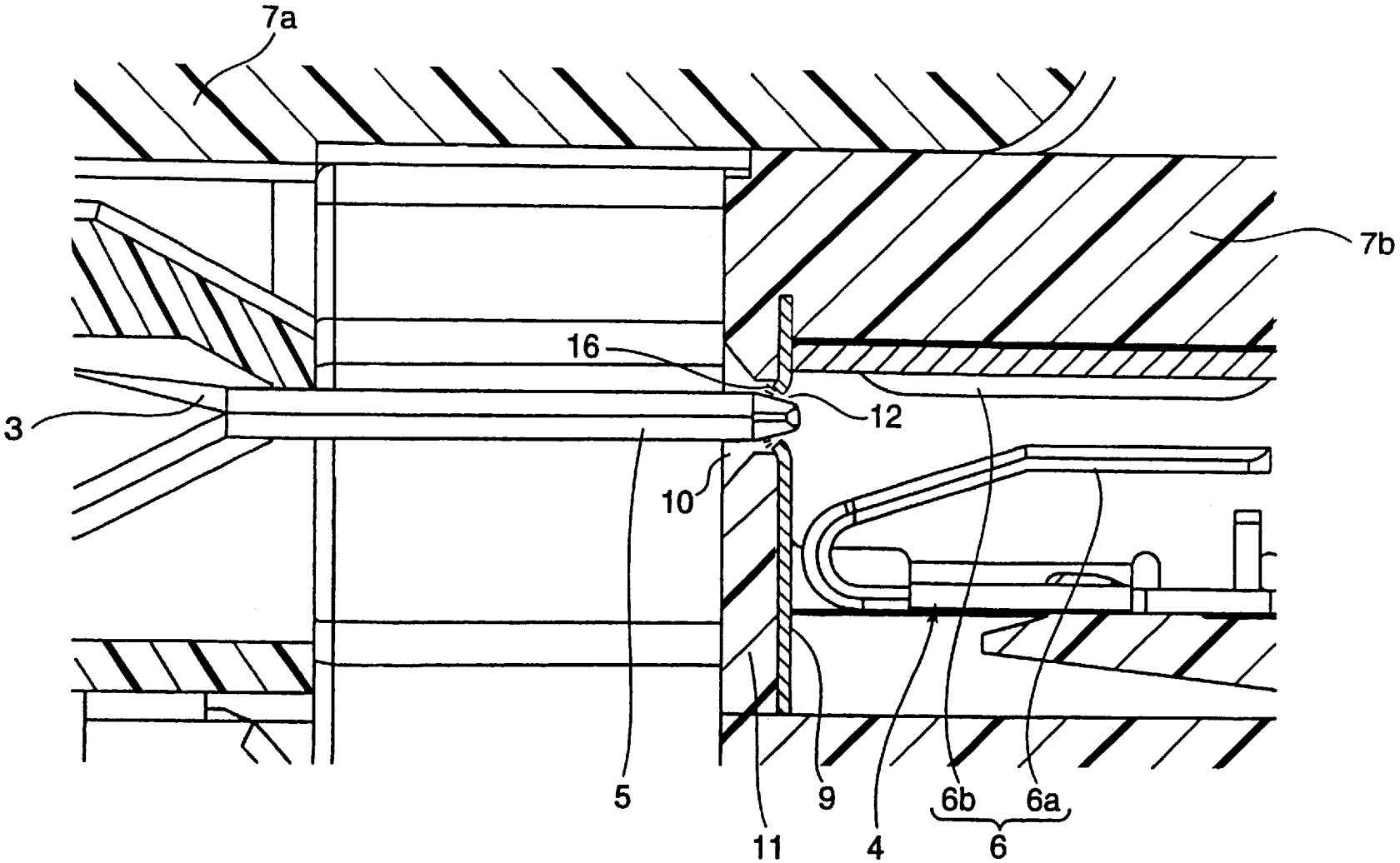
FIG. 4 is a sectional side view showing a state that the terminals in FIG. 2 are brought to a completely disengaged state.

At the time when the male tab 5 is about to be detached from the metallic film 9, as shown in FIG. 4, however, there is a likelihood that arc 116 may be discharged at contact portions between the male tab 5 and the metallic film 9. However, since the metallic film 9 has a very small thickness compared with the nipping portion 6, emission of metallic vapor due to arc discharge is immediately suppressed even if the arc 116 is discharged. The once discharged arc immediately disappears. In other words, compared to a case where arc is discharged at a large contact portion between the terminals, the degree of occurrence of arc discharge is extremely small, which provides a damage-free male tab 5.

In this embodiment, a configuration (particularly, a configuration with respect to a front surface) of the metallic film 9 and a site of forming the metallic film 9 are not limited. As far as the metallic film is kept in a contact state with the male terminal 3 and the female terminal 4 at a detachment of the male tab 5 from the nipping portion 6, any configuration of the metallic film 9 and site for forming the metallic film 9 are applicable.

The following are examples with respect to the configuration of the metallic film 9 and the site thereof.

Figure 5A:
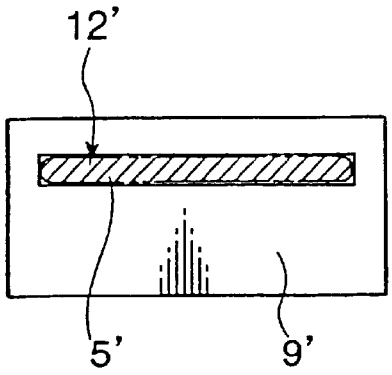
FIGS. 5A to 5E are front views respectively showing examples on configuration of a conductive metallic film provided in the connector shown in FIG. 1.

For instance, as shown in FIG. 5A, an opening 12' of a metallic film 9' may have substantially the same (or slightly smaller) perimeter compared to the outer circumference of a male tab 5. In this alteration, it is possible to make a male tab 5' into a linear contact with the metallic film 9' over the outer circumference of the male tab 5'. In the case where the opening 12' has a relatively smaller sectional area compared to a cross section of the male tab 5', it is highly likely that a portion of the metallic film 9' around the opening 12' may be deformed in the inserting direction of the male tab 5' when the male tab 5' is inserted, which results in a surface contact of the male tab 5' with the metallic film 9'.

Figure 5B:
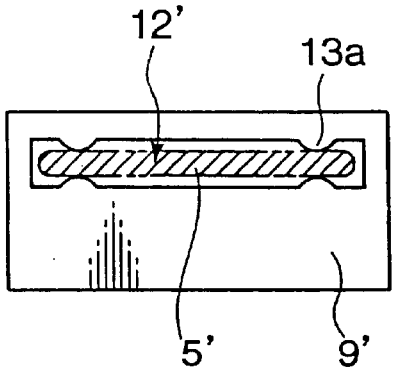
Figure 5C:
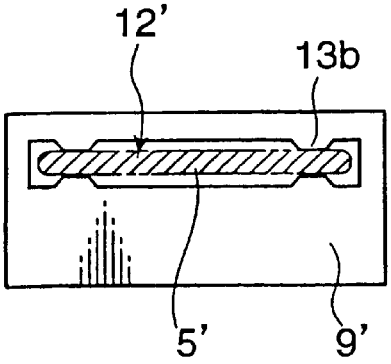

Alternatively, as shown in FIG. 5B or 5C, an opening 12' may have a slightly larger perimeter (in the drawings, generally a rectangular shape) than the outer circumference of a male tab 5' and at least one projection (namely, contact portion) may be provided in the following manner. In FIG. 5B (5C), four contact portions 13*a* (13*b*) which projects inwardly are provided in such a manner that the contact projections 13*a* (13*b*) are rendered into point (linear) contact with the male tab 5'.

As a further altered arrangement, a sufficiently large protruded amount of the contact projections 13*a* (13*b*) may be secured in such a manner that the contact projections 13*a* (13*b*) are sufficiently deformed in the inserting direction of the male tab 5' as the male tab 5' is inserted to thereby render the male tab 5' into surface contact with the contact projections 13*a* (13*b*) of the metallic film 9'.

Figure 5D:
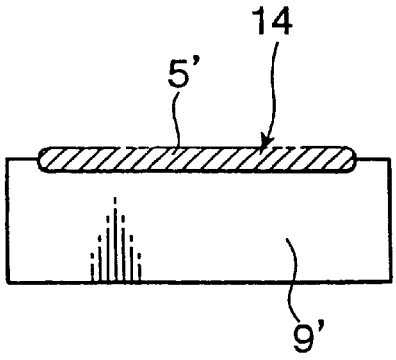

Alternatively, in place of an opening 12, a recessed part 14 which is rendered into slidable contact with a male tab 5' may be formed in a metallic film 9', as shown in FIG. 5D.

Figure 5E:
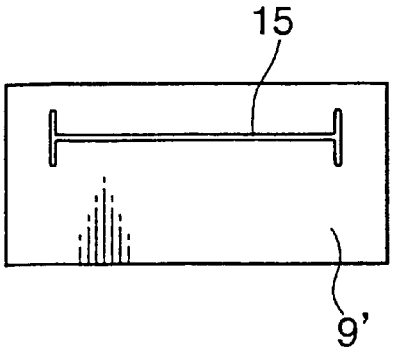

Alternatively, as shown in FIG. 5E, a slit 15 may be formed in a metallic film 9' in place of an opening 12. The width of the slit 15 may be such that a male tab 5' is insertable and the metallic film 9' and the male tab 5' are rendered into contact (surface contact) when the male tab 5' is inserted.

Particularly, as shown in FIG. 5B (5C) in which the contact projections 13*a* (13*b*) are provided, it is preferable to form a plurality of contact parts which are rendered into contact with the corresponding terminal at independently different positions. In this arrangement, even if arc discharge occurs at the contact portion(s) between the male tab 5' and the metallic film 9' which may result in emission of metallic vapor from the contact portion(s) (namely, result in loss of the metallic part), the connectors can securely provide arc discharge suppressing effect for a certain number of times because the male tab 5' can be kept in a contact state with the remaining contact portions of the metallic film 9'.

The outer configuration of the metallic film 9 is not limited as well as the configuration of the opening 12 of the metallic film 9, and various alterations are applicable.

The site for forming the metallic film 9 is also not limited. As far as the metallic film 9 is electrically connectable to the female terminal 4 and the metallic film 9 can maintain its contact state with the male terminal 3 at the detachment of the male terminal 3 and the female terminal 4, it is not necessarily required to adhere the metallic film 9 on the backside of the front wall 11 of the housing 7*b* of the female connector 2. For instance, the metallic film 9 may be adhered on the front surface of the front wall 11.

Further, the metallic film 9 may be provided on the male connector 1 in place of the female connector 2, or alternatively, may be provided both on the male connector 1 and the female connector 2. In the case where the metallic film 9 is provided on the male connector 1 and the female connector 2, the respective metallic films 9 may be rendered into contact with the corresponding male (female) connector, or the respective metallic films 9 may be rendered into contact state with each other. In other words, as far as the metallic films 9 are kept in a contact state at the detachment of the male terminal 3 from the female terminal 4, the terminals 3 and 4 are kept in an electrically connectable state via the metallic films, whereby arc discharge at a detachment of the male terminal 3 from the female terminal 4 can be prevented.

The thinner the metallic film is, the more the arc discharge amount can be suppressed. In view of this, an upper limit of the thickness of the metallic film 9 may be 200 $\mu$m or less, preferably 100 $\mu$m or less, more preferably 50 $\mu$m or less. If the metallic film is too thin, however, the strength of the metallic film is lowered. In view of this, a lower limit of the thickness of the metallic film 9 may be 10 $\mu$m or larger, preferably 20 $\mu$m or larger, more preferably 30 $\mu$m or larger.

As far as the metallic film 9 has such a conductivity that suppresses arc discharge around the contact portion between the terminals at the time of detachment thereof, any material for the metallic film 9 can be used. Generally, a metallic film having conductivity substantially equal to that of the terminal can be used. Preferably, the metallic film includes a copper film.

Various configurations of the male tab 5 including a rod-like shape are applicable as well as a plate-like shape. Various configurations of the nipping portion 6 may be applicable as far as the nipping portion 6 is electrically contacted with the male tab 5.

According to the above arrangement of the connectors, since arc discharge at the contact portion between the terminals is prevented by utilizing the metallic film, there is no likelihood that the terminals are subjected to deformation even if the connectors are disengaged in a state that a high voltage (e.g., level of about 42V) is supplied therebetween. Accordingly, the connectors of the invention are suitable for a wire harness in an automotive vehicle or the like because deformation of the terminals can be prevented even if the connectors are disengaged for maintenance and checkup of an automotive vehicle or the like.

Next, an arc suppressive connector in accordance with a second embodiment of the invention is described with reference to FIGS. 6 to 7B.

It should be appreciated that elements of the second embodiment which are identical to those of the first embodiment are denoted at the same reference numerals, and a description thereof is omitted herein.

Figure 6:
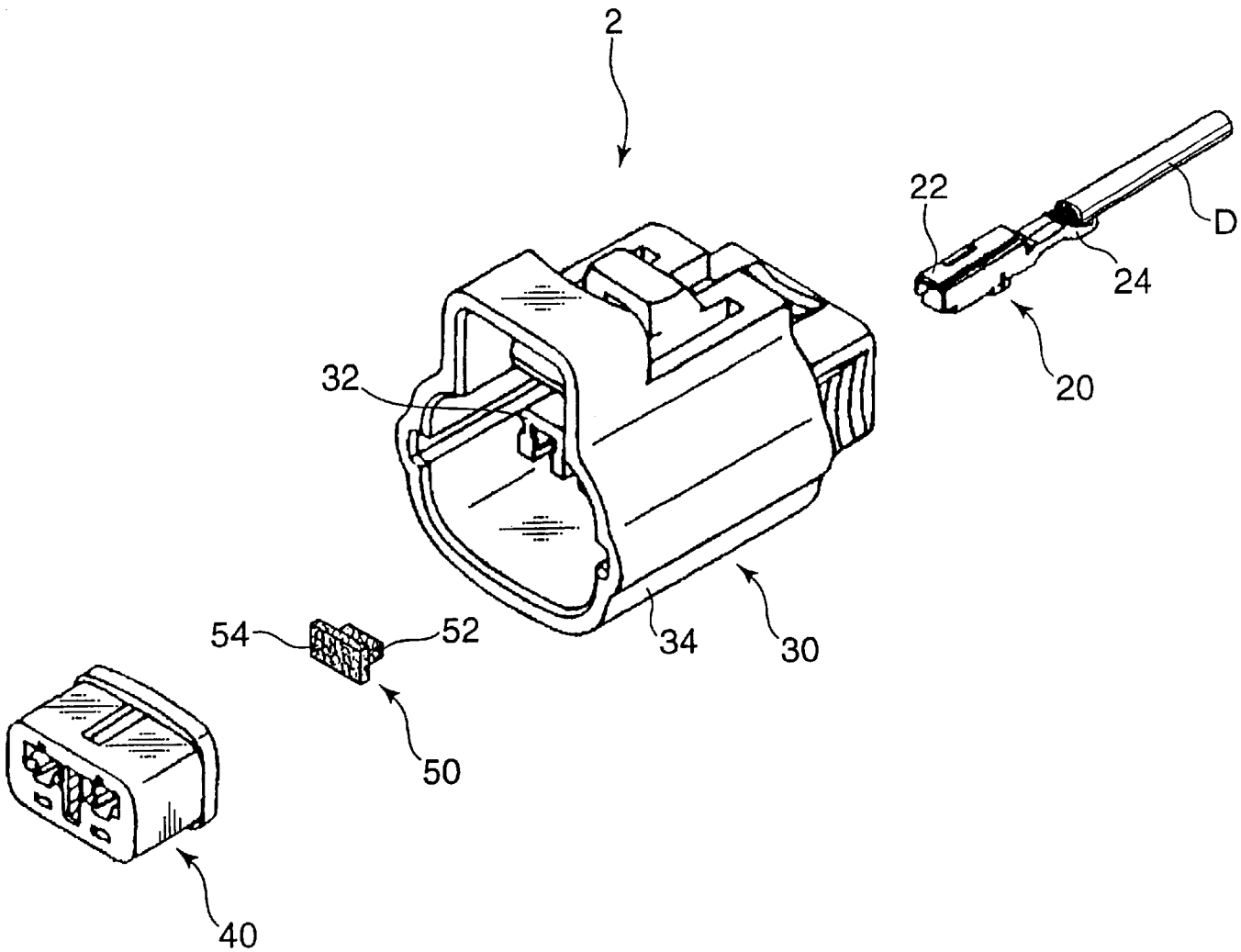
FIG. 6 is an explosive perspective view of an arc suppressive connector in accordance with a second embodiment of the invention.
Figure 7A:
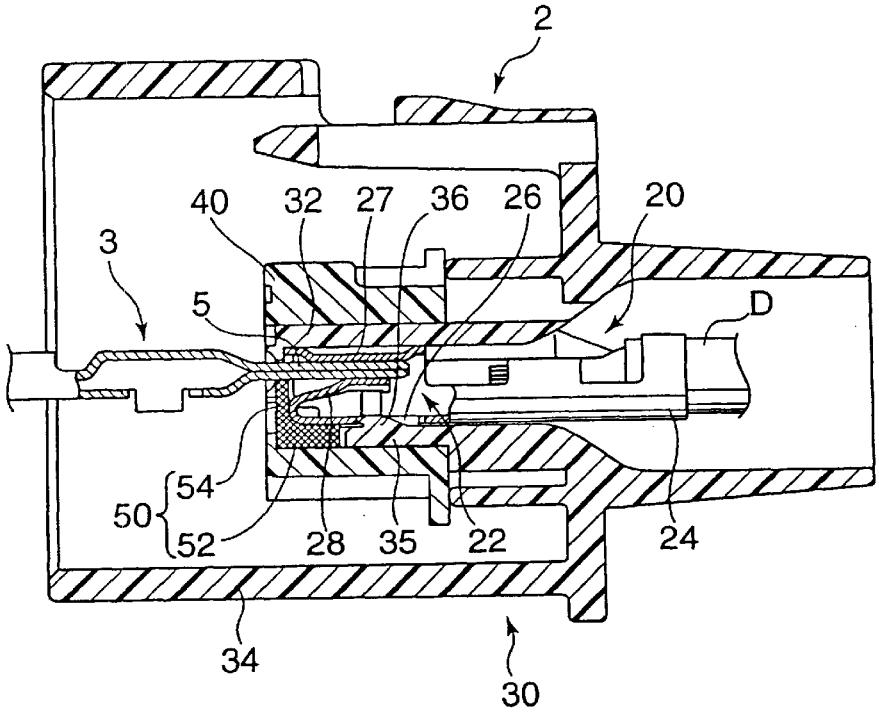
FIGS. 7A and 7B are sectional side views respectively showing a state that a terminal is engaged with a counterpart terminal in the connector shown in FIG. 6 and a state that the counterpart terminal is about to be detached from an arc suppressive member in the connector.

A female connector 2 shown in FIG. 6 corresponds to an arc suppressive connector in accordance with the second embodiment of the invention. The female connector 2 is provided with a female terminal 20, a housing main body 30 which houses the female terminal 20 therein, a retainer member 40, and an arc suppressive member 50 which is a primary feature of this embodiment.

The female terminal 20 is, as shown in FIG. 6, made of a single metallic plate. The female terminal 20 includes an electric contact portion 22 engageable with a counterpart male terminal 3, and a barrel portion 24 for securely holding an electric wire D as an integral unit. The electric contact portion 22 has a box-like shape to receive a male tab 5 of the male terminal 3, and is formed with a through engaging hole 26 in a thickness direction of a bottom wall thereof.

A plate-like piece 27 is formed on a top wall of the electric contact portion 22 to extend downwardly therefrom. A tongue-like piece 28 which is constructed by folding a plate with one end thereof extending rearwardly is formed at a frontal end of the bottom wall of the electric contact portion 22. Inserting the male tab 5 between the tongue-like piece 28 and the plate-like piece 27 while resiliently deforming the tongue-like piece 28 downwardly enables to resiliently hold the male tab 5 between the tongue-like piece 28 and the plate-like piece 27 (namely, to bring out a securely engaged state of the female terminal 20 with the male terminal 3). Thereby, the male terminal 3 and the female terminal 20 are electrically connected so as to render the female connector 2 and a counterpart male connector electrically communicable.

The housing main body 30 is integrally molded of an insulating material such as a synthetic resin. The housing main body 30 includes a tubular terminal housing portion (terminal housing chamber) 32 and a cover member 34 for covering the terminal housing portion 32. An obliquely and upwardly extending lance member 35 is formed on a bottom wall of the terminal housing portion 32. An engaging projection 36 is formed at a distal end of the lance member 35. The engaging projection 36 is engaged with the engaging hole 26 of the female terminal 20 as the lance member 35 is resiliently deformed to thereby fittingly hold the female terminal 20 in the terminal housing portion 32.

Similar to the construction of the housing main body 30, the retainer member 40 is made of an insulating material. The retainer member 40 and the housing main body 30 constitute a connector housing. The retainer member 40 has a tubular shape. Mounting the retainer member 40 from a forward direction of the female connector 2 onto the terminal housing portion 32 positions the lance member 35 of the terminal housing portion 32 at a position where the lance member 35 is inwardly deformed (positions shown in FIGS. 7A and 7B). The lance member 35 at the inwardly-deformed position securely keeps the female terminal 20 from being slipped off from the terminal housing portion 32.

The arc suppressive member 50 has a block shape in this embodiment. The arc suppressive member 50 includes, as an integral unit, a base member 52 positioned at a frontal end on a bottom wall of the terminal housing chamber 32, and a contact portion 54 extending upwardly from the base member 52. Fittingly mounting the retainer member 40 onto the terminal housing portion 32 in a state that the arc suppressive member 50 comes into contact with a frontal end of the female terminal 20 (specifically, a frontal end surface of the tongue-like piece 28) in the terminal housing portion 32 from a forward direction of the female connector 2 enables to securely hold the arc suppressive member 50 at such a position as to render the contact portion 54 into contact with a lower surface of the male tab 5 of the male terminal 3 at a forward position of the female terminal 20.

Preferably, the arc suppressive member 50 may be made of a metal having a large conductivity (e.g., Ni, Sn, Ag, Au, Cu, Fe) at least on a surface thereof corresponding to a portion where the female terminal 20 is disengaged from the male terminal 3 at a final stage of disengagement, and a multitude of small protrusions and recesses may be formed on the surface thereof. Specifically, it is preferable to use a conductive foamed metal member which is producible by foaming the aforementioned metal at a relatively high porosity or a conductive metal wool which is producible by forming a mass of metallic fibers having a large conductivity into a certain shape. Both of the configurations are advantageous in efficiently suppressing arc discharge because the counterpart male terminal 3 is disengaged from the female terminal 20 via the small protrusions formed on the surface of the arc suppressive member 50 at a final stage of disengagement.

An operation of the above arrangement is described in detail. When the male terminal 3 is drawn out from the female terminal 20 from a securely engaged position shown in FIG. 7A, at first, the male terminal 3 is detached from the female terminal 20. At this stage, since the male terminal 3 is kept in contact with the arc suppressive member 50, and the contact portion 54 of the arc suppressive member 50 is in contact with the lower surface of the male tab 5, the male terminal 3 and the female terminal 20 are kept in an electrically communicable state via the arc suppressive member 50. Thus, arc discharge between the male terminal 3 and the female terminal 20 is securely prevented at this stage.

Subsequently, the male tab 5 is detached from the contact portion 54 of the arc suppressive member 50 at a final stage of disengagement of the male terminal 3 from the female terminal 20. At this final stage of disengagement, the male tab 5 is detached from the arc suppressive member 50 by way of a multitude of small protrusions formed on the surface of the arc suppressive member 50. With this arrangement, even if arc discharge may occur between the male tab 5 and the arc discharge member 50, supply of metallic vapor necessary to carry on arc discharge is instantaneously blocked due to the arc suppressive member 50. This arrangement efficiently suppresses deformation and damage of the male tab 5 resulting from continuation of arc discharge.

The arc suppressive member 50 may be configured optimally according to the specifications of the connector. As long as the arc suppressive member has such a construction capable of forming an opening in the similar manner as the conductive metallic film 9 shown in FIG. 1, it may be preferable to form such an opening in the arc suppressive member to insert a counterpart terminal therethrough.

Figure 7B:
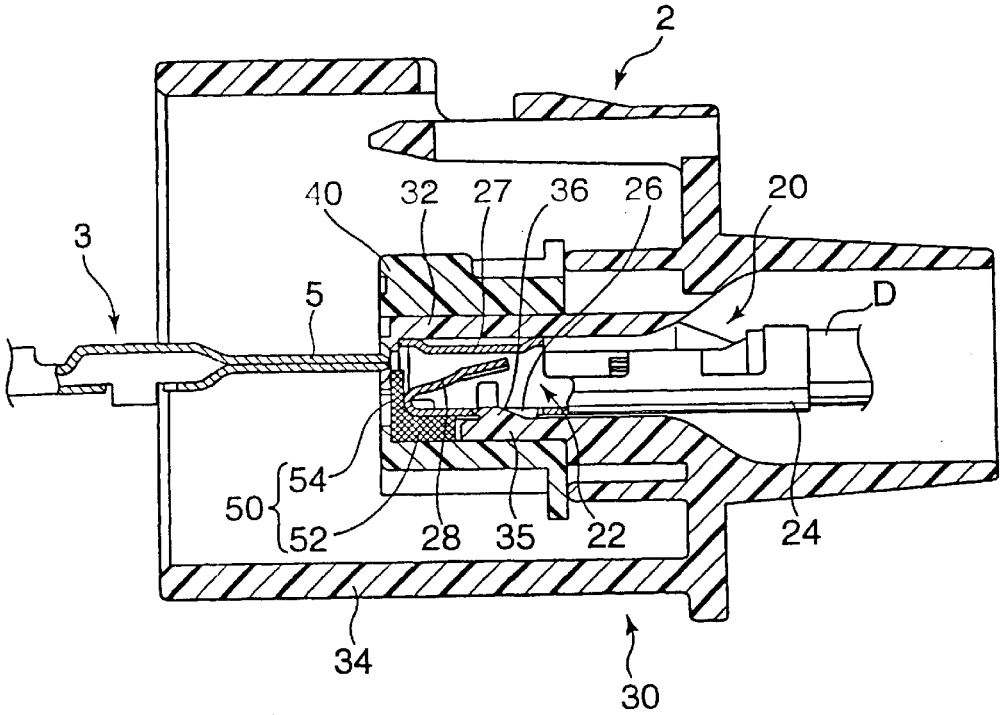

Alternatively, the arc suppressive member 5 may be such that a primary member having a configuration as shown in FIGS. 6 through 7B (configuration corresponding to the base member 52 and the contact portion 54) is made of an insulating material such as a synthetic resin and a conductive film is attached on the surface thereof by a metal plating or the like. In this altered arrangement, since the conductive film is thin, supply of metallic vapor necessary for continuation of arc discharge is instantaneously blocked between the conductive film and the counterpart terminal even if arc discharge occurs. This altered arrangement efficiently suppresses deformation and damage of the counterpart terminal resulting from arc discharge.

As described above, an inventive connector comprises a terminal electrically connectable with a counterpart terminal, a housing for accommodating the terminal therein, and an arc suppressive member which is electrically connected with the terminal and is provided at such a position as to come into contact with the counterpart terminal for a predetermined time after the counterpart terminal is disengaged from the terminal, the arc suppressive member having such a construction as to assure a smaller discharge arc amount when the counterpart terminal becomes detached from the arc suppressive member than a discharge arc amount when the counterpart terminal becomes detached from the terminal.

With this arrangement, even after the terminal is about to be disengaged from the counterpart terminal, the electrical connection between the terminals is maintained via the arc suppressive member for a predetermined time. Accordingly, there is no likelihood that arc may be discharged between the terminals at the time of disengagement. When the counterpart terminal is about to be detached from the arc suppressive member at a final stage of disengagement, there remains a likelihood that arc may be discharged between the counterpart terminal and the arc suppressive member. However, since the amount of discharged arc when the counterpart terminal is detached from the arc suppressive member is significantly smaller than the amount of discharged arc when the terminals are about to be disengaged, this arrangement efficiently suppresses deformation or damage of the terminal due to arc discharge.

Preferably, a conductive portion of the arc suppressive member may have a smaller contact area in contact with the counterpart terminal at a final stage of disengagement. Specifically, the conductive portion may include a conductive metallic film having a small thickness, and an element whose surface corresponding to a part where the arc suppressive member is detached from the counterpart terminal at a final stage of disengagement is made of a conductive material, wherein the surface is formed with a multitude of small protrusions and recesses.

As a latter case, the element includes a conductive foamed metal element having a surface thereof formed with distinctive protrusions and recesses, or a conductive metal wool producible from a mass of a multitude of metallic fibers having a very small diameter. In these arrangements, since a multitude of protrusions and recesses are formed on the surface of the arc suppressive member, even if part of the protrusions are lost due to discharged arc, the arc suppressive member can effectively suppress arc discharge at the other parts of the protrusions when the terminals are disengaged from each other for a next time. Thus, this arrangement enables to maintain an efficient arc discharge suppression effect for an extended period.

Preferably, the arc suppressive member may include a primary member made of an insulating material and a conductive film attached on a surface of the primary member. The conductive film is provided at such a position as to be detached from the counterpart terminal at a final stage of disengagement. In this altered arrangement, since supply of metallic vapor necessary for continuation of arc discharge is instantaneously blocked, the arrangement can efficiently suppress deformation and damage of the counterpart terminal resulting from arc discharge.

The terminal is a female terminal, and the conductive metallic film is arranged at such a position as to be rendered into contact with the counterpart male terminal. This arrangement is advantageous in effectively protecting the male terminal which is subjected to deformation due to arc discharge. In this case, the arc suppressive member may have such a construction as to be rendered into contact with the counterpart male terminal at a forward position of the female terminal.

More specifically, holding the arc suppressive member in the housing in a contact state with a front end of the female terminal enables to securely carry on electric connection between the arc suppressive member and the female terminal without providing an additional conductive member for electric connection and securely render the male terminal in contact with the arc suppressive member when the male terminal is about to be disengaged from the female terminal.

In the case where a conductive metallic film is used as the arc suppressive member, preferably, the counterpart terminal is a male terminal, the conductive metallic film is formed with an opening for inserting the male terminal, and the opening has such a configuration that the male terminal is rendered into contact with an inner perimeter of the opening. With this arrangement, the conductive metallic film can be more securely rendered into contact with the male terminal by way of the inner perimeter of the opening.

Preferably, the conductive metallic film may be formed with a plurality of contact parts at such a position as to be rendered into contact with the counterpart terminal at different positions. With this arrangement, even if part of the contact portions is lost due to arc discharge, a desirable arc discharge suppression effect can be carried on by the remaining contact portions.

In the case where the terminal is a female terminal, the conductive metallic film may be formed with an opening having a cross sectional area substantially larger than a cross sectional area of the counterpart male terminal, a plurality of projections may be formed on an inner perimeter of the opening, and the projections may protrude inwardly in such a manner that the projections are rendered into contact with the counterpart male terminal.

This application is based on patent application Nos. 2001-26589 and 2001-383402 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A connector comprising:

a female terminal which is to be electrically connected with a male terminal;

a housing for accommodating the female terminal; and an arc suppressive member which is electrically connected with the female terminal and is arranged at such a position as to come into contact with the male terminal at a forward position of the female terminal and to be in contact with the male terminal for a predetermined time after the male terminal is disengaged from the female terminal, the arc suppressive member including a conductive portion at least on a surface thereof which becomes detached from the counterpart terminal at a final stage of disengagement, and the surface is formed with a multitude of protrusions and recesses.

2. A connector comprising:

a female terminal which is to be electrically connected with a male terminal;

a housing for accommodating the female terminal; and an arc suppressive member which is electrically connected with the female terminal and is arranged at such a position as to come into contact with the male terminal at a forward position of the female terminal and to be in contact with the male terminal for a predetermined time after the male terminal is disengaged from the female terminal, the arc suppressive member including a primary member made of an insulating material and a conductive film attached thereon, the conductive film being arranged at such a position as to become detached from the counterpart terminal at a final stage of disengagement.

3. A connector comprising:

a female terminal which is to be electrically connected with a male terminal;

a housing for accommodating the female terminal; and an arc suppressive member which is electrically connected with the female terminal and is arranged at such a position as to come into contact with the male terminal at a forward position of the female terminal and to be in contact with the male terminal for a predetermined time after the male terminal is disengaged from the female terminal, the arc suppressive member including a conductive metallic film, wherein the arc suppressive member is held in the housing in a contact state with a front end of the female terminal.

4. The connector according to claim 3, wherein the counterpart terminal is a male terminal, and the conductive metallic film is formed with an opening for inserting the male terminal, the opening having such a configuration that the male terminal comes into contact with an inner perimeter of the opening.

5. The connector according to claim 3, wherein the conductive metallic film is formed with a plurality of contact parts at such a position as to come into contact with the counterpart terminal at different positions.

6. The connector according to claim 5, wherein the terminal is a female terminal, the conductive metallic film is formed with an opening having a cross sectional area substantially larger than a cross sectional area of the counterpart terminal, and a plurality of projections are formed on an inner perimeter of the opening, the projections protruding inwardly in such a manner that the projections come into contact with the counterpart terminal.

7. A connector comprising:

a terminal which is to be electrically connected with a counterpart terminal;

a housing for accommodating the terminal; and an arc suppressive member which is electrically connected with the terminal and is arranged at such a position as to come into contact with the counterpart terminal at a forward position of the terminal and to be in contact with the counterpart terminal for a predetermined time after the counterpart terminal is disengaged from the female terminal, the arc suppressive member including a conductive portion at least on a surface thereof which becomes detached from the counterpart terminal at a final stage of disengagement, and the surface is formed with a multitude of protrusions and recesses.

8. The connector according to claim 7, wherein the arc suppressive member includes a conductive foamed metal element.

9. The connector according to claim 7, wherein the arc suppressive member includes a conductive metal wool.

10. A connector comprising:

a terminal which is to be electrically connected with a counterpart terminal;

a housing for accommodating the terminal; and an arc suppressive member which is electrically connected with the terminal and is arranged at such a position as to come into contact with the counterpart terminal at a forward position of the terminal and to be in contact with the counterpart terminal for a predetermined time after the counterpart terminal is disengaged from the female terminal, the arc suppressive member including a primary member made of an insulating material and a conductive film attached thereon, the conductive film being arranged at such a position as to become detached from the counterpart terminal at a final stage of disengagement.

11. A connector comprising:

a terminal which is to be electrically connected with a counterpart terminal;

a housing for accommodating the terminal; and an arc suppressive member which is electrically connected with the terminal and is arranged at such a position as to come into contact with the counterpart terminal at a forward position of the terminal and to be in contact with the counterpart terminal for a predetermined time after the counterpart terminal is disengaged from the female terminal, the arc suppressive member including a conductive metallic film.

12. The connector according to claim 11, wherein the counterpart terminal is a male terminal, and the conductive metallic film is formed with an opening for inserting the male terminal, the opening having such a configuration that the male terminal comes into contact with an inner perimeter of the opening.

13. The connector according to claim 11, wherein the conductive metallic film is formed with a plurality of contact parts at such a position as to come into contact with the counterpart terminal at different positions.

14. The connector according to claim 13, wherein the terminal is a female terminal, the conductive metallic film is formed with an opening having a cross sectional area substantially larger than a cross sectional area of the counterpart terminal, and a plurality of projections are formed on an inner perimeter of the opening, the projections protruding inwardly in such a manner that the projections come into contact with the counterpart terminal.

* * * * *